US010823509B2

(12) United States Patent
Suzuki

(10) Patent No.: US 10,823,509 B2
(45) Date of Patent: Nov. 3, 2020

(54) HEAT EXCHANGER AND MANUFACTURING METHOD THEREOF

(71) Applicant: DENSO CORPORATION, Kariya (JP)

(72) Inventor: Kazutaka Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 196 days.

(21) Appl. No.: 16/094,488

(22) PCT Filed: Mar. 13, 2017

(86) PCT No.: PCT/JP2017/009899

§ 371 (c)(1),
(2) Date: Oct. 18, 2018

(87) PCT Pub. No.: WO2017/183358

PCT Pub. Date: Oct. 26, 2017

(65) Prior Publication Data

US 2019/0120561 A1 Apr. 25, 2019

(30) Foreign Application Priority Data

Apr. 20, 2016 (JP) ..... 2016-084613

(51) Int. Cl.
*F28D 7/16* (2006.01)
*B21D 53/02* (2006.01)
(Continued)

(52) U.S. Cl.
CPC ..... *F28D 7/1607* (2013.01); *B21D 39/02* (2013.01); *B21D 53/02* (2013.01); *F28D 7/16* (2013.01);
(Continued)

(58) Field of Classification Search
CPC ..... F28D 7/1607; F28D 7/16; F28D 9/0056; B21D 39/02; B21D 53/02; F28F 9/02; F28F 9/0221; F28F 9/16; F28F 2275/122
See application file for complete search history.

(56) References Cited

U.S. PATENT DOCUMENTS 4,119,144 A * 10/1978 Kun ..... B21D 22/04 165/175
4,461,348 A * 7/1984 Toge ..... F28F 9/0226 165/149
(Continued)

FOREIGN PATENT DOCUMENTS

DE 3412632 A1 11/1984
DE 19982797 T1 3/2001
(Continued)

*Primary Examiner* — Ljiljana V. Ciric
(74) *Attorney, Agent, or Firm* — Harness, Dickey & Pierce, P.L.C.

(57) ABSTRACT

A heat exchanger includes a duct, a core accommodated in the duct and exchanging heat between a first fluid and a second fluid, a tank having a protrusion protruding outward from an edge portion, and a crimping plate. The crimping plate includes an opposing wall facing an edge of the tank adjacent to the duct, and an outer wall extending from an outer circumference of the opposing wall. The opposing wall or an inner circumference of the opposing wall is joined to the duct and fixes the tank. The protrusion includes a surface facing in a direction angled toward the inner space from a direction in which the outer wall extends from the opposing wall.

8 Claims, 9 Drawing Sheets

(51) Int. Cl.

| | |
|---|---|
| ***F28F 9/16*** | (2006.01) |
| ***B21D 39/02*** | (2006.01) |
| ***F28F 9/02*** | (2006.01) |
| ***F28D 9/00*** | (2006.01) |

(52) U.S. Cl.
CPC ..... *F28D 9/0056* (2013.01); *F28F 9/02* (2013.01); *F28F 9/0221* (2013.01); *F28F 9/16* (2013.01); *F28F 2275/122* (2013.01)

(56) References Cited

U.S. PATENT DOCUMENTS

| | | | | |
|---|---|---|---|---|
| 6,305,465 | B1 * | 10/2001 | Uchikawa | F28D 1/0435 165/135 |
| 6,857,812 | B1 * | 2/2005 | Kergen | B21D 39/02 29/521 |
| 9,097,466 | B2 | 8/2015 | Braic et al. | |
| 10,125,668 | B2 * | 11/2018 | Ferlay | F28F 9/001 |
| 2002/0134529 | A1 * | 9/2002 | Nozaki | F28F 9/0226 165/51 |
| 2005/0039894 | A1 | 2/2005 | Brost et al. | |
| 2006/0185833 | A1 * | 8/2006 | Brost | F28F 9/0224 165/149 |
| 2008/0121386 | A1 * | 5/2008 | Hakamata | B21D 53/02 165/173 |
| 2008/0314076 | A1 * | 12/2008 | Ichiyanagi | F28F 9/0246 62/513 |
| 2009/0095458 | A1 * | 4/2009 | Lim | F28F 9/0224 165/174 |
| 2010/0051252 | A1 * | 3/2010 | Ninagawa | F28F 9/16 165/175 |
| 2014/0196876 | A1 * | 7/2014 | Riondet | B23P 15/26 165/173 |
| 2015/0129188 | A1 * | 5/2015 | Frankiewicz | B23P 15/26 165/173 |
| 2015/0233654 | A1 | 8/2015 | Farlow | |
| 2017/0038163 | A1 * | 2/2017 | Hakamata | F28D 1/05383 |
| 2019/0137184 | A1 * | 5/2019 | Hakamata | F28D 1/053 |
| 2019/0346211 | A1 * | 11/2019 | Asano | F28F 9/04 |
| 2020/0116431 | A1 * | 4/2020 | Mieda | F28F 9/02 |
| 2020/0166296 | A1 * | 5/2020 | Klusek | F28F 21/067 |
| 2020/0173726 | A1 * | 6/2020 | Nishiyama | F28D 7/16 |

FOREIGN PATENT DOCUMENTS

| | | | |
|---|---|---|---|
| DE | 10335344 | A1 | 3/2005 |
| DE | 102014207511 | A1 | 10/2014 |
| FR | 2875592 | A1 | 3/2006 |
| GB | 2138335 | A | 10/1984 |
| JP | S6211492 | U | 7/1987 |
| JP | 2002531271 | A | 9/2002 |
| JP | 2008132572 | A | 6/2008 |
| JP | 2009030951 | A | 2/2009 |
| WO | WO-2008034829 | A1 | 3/2008 |

* cited by examiner

HEAT EXCHANGER AND MANUFACTURING METHOD THEREOF

CROSS REFERENCE TO RELATED APPLICATIONS

This application is a U.S. National Phase Application under 35 U.S.C. 371 of International Application No. PCT/JP2017/009899 filed on Mar. 13, 2017. This application is based on and claims the benefit of priority from Japanese Patent Application No. 2016-084613 filed on Apr. 20, 2016. The entire disclosures of all of the above applications are incorporated herein by reference.

TECHNICAL FIELD

The present disclosure relates to a heat exchanger that exchanges heat between a first fluid and a second fluid, and a method for manufacturing the heat exchanger.

BACKGROUND ART

This type of heat exchanger includes a core that includes a tube defining a passage of a cooling fluid and a fin for cooling, a duct that surrounds the core and defining a passage communicating with a supercharger, and a casing cover that is a tank joined with the duct. For example, Patent Literature 1 discloses such heat exchanger.

In the heat exchanger, an inner peripheral surface of a crimping plate is joined by brazing with the duct that surrounds the core. The crimping plate is crimped and fixed to the casing cover by exerting stress to a part of the crimping plate from one side of the crimping plate so as to push toward the casing cover to elastically deform the crimping plate.

PRIOR ART DOCUMENT

Patent Document

SUMMARY OF THE INVENTION

When the duct is engaged with an inner peripheral surface of the crimping plate as in Patent Literature 1, it is not possible to provide a supporting member on the inner peripheral side of the crimping plate to support the inner peripheral side of the crimping plate. As a result, a large stress may be exerted on the core during crimping the crimping plate, and the core may be deformed inward.

It is an objective of the present disclosure to suppress a deformation of a core while a crimping plate is fixed to a tank by crimping.

According to a first aspect of the present disclosure, a heat exchanger that exchanges heat between a first fluid and a second fluid includes: a duct defining therein a first passage through which the first fluid flows, the duct including an inlet port for the first fluid located on one end side of the first passage, and an outlet port for the first fluid located on another end side of the first passage; a core accommodated in the duct and defining therein a second passage through which the second fluid flows, the core exchanging heat between the first fluid and the second fluid; a tank including a tank body defining an inner space connected to a duct opening that is one of the inflow port and the outflow port, and a protrusion protruding outward from an edge portion of the tank body; and a crimping plate joined to the duct and fixing the tank, the crimping plate including an opposing wall surrounding the inlet port or the outlet port and facing an edge of the tank that is adjacent to the duct, the opposing wall or an inner circumference of the opposing wall being joined to the duct, and an outer wall extending from an outer circumference of the opposing wall toward the tank. The protrusion includes a surface facing in a direction angled toward the inner space from a direction in which the outer wall extends from the opposing wall.

According to this, since the outer wall of the crimping plate is crimped while a pushing member is engaged with the surface of the protrusion facing in the direction angled from the direction in which the outer wall extends from the opposing wall, a crimping stress exerted on the duct can be reduced. Accordingly, deformation of the core during crimping and fixing the crimping plate to the tank can be suppressed.

According to another aspect of the present disclosure, a method for manufacturing a heat exchanger that exchanges heat between a first fluid and a second fluid includes: providing a duct that defines therein a first passage through which the first fluid flows, includes an inlet port for the first fluid located on one end side of the first passage, and an outlet port for the first fluid located on another end side of the first passage, and accommodates a core defining therein a second passage through which the second fluid flows, the core exchanging heat between the first fluid and the second fluid; providing a tank that includes a tank body defining an inner space connected to a duct opening that is one of the inflow port and the outflow port, and an outer protrusion extending protruding outward from an edge portion of the tank body, the outer protrusion being located between the tank body and the outer wall; providing a crimping plate that is joined to the duct and fixes the tank, the crimping plate including an opposing wall surrounding the inlet port or the outlet port and facing an edge of the tank that is adjacent to the duct, the opposing wall or an inner circumference of the opposing wall being joined to the duct, and an outer wall extending from an outer circumference of the opposing wall toward the tank; and crimping and fixing the outer wall of the crimping plate to the tank by pushing the outer wall in a direction intersecting the direction in which outer wall extends from the opposing wall in a state where the outer protrusion of the tank is being pushed and fixed with a pushing member. Regarding the providing the tank, the tank includes the contact surface that faces in the direction angled toward the inner space from the direction in which the outer wall of the opposing wall. The contact surface contacts with the pushing member. In the crimping the outer wall of the crimping plate to fix to the tank, a part of the crimping plate is crimped while a motion of the tank in the direction in which the tank is pushed is limited by abutting the pushing member onto the contact surface.

According to this, since the tank includes the contact surface that faces in the direction angled to the direction in which the outer wall of the opposing surface extends and contacts to a pushing member, and the tank is fixed by crimping while motion of the tank in the direction of the pressure exerted on the tank is limited by contacting the pushing member to the contact surface of the tank, deformation of the core during the crimping and fixing the crimping plate to the tank can be suppressed.

EMBODIMENTS FOR EXPLOITATION OF THE INVENTION

Figure 1:
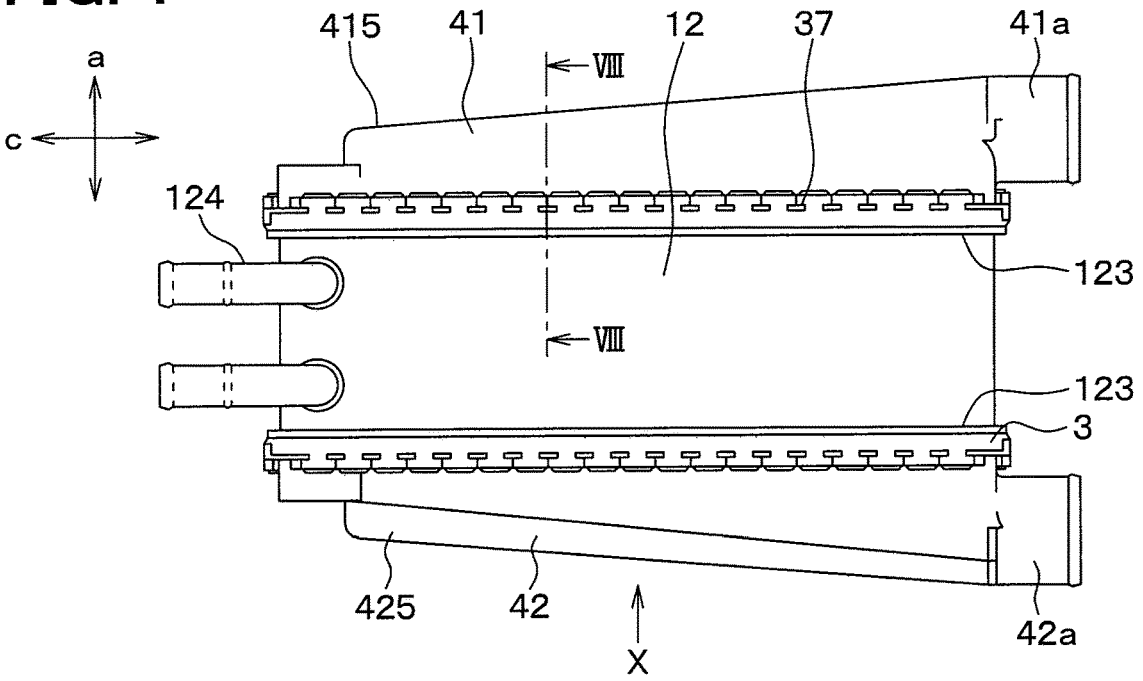
FIG. 1 is a plan view of a heat exchanger according to a first embodiment.

Hereinafter, embodiments of the present disclosure will be described with reference to the drawings. In the following embodiments, identical or equivalent elements are denoted by the same reference numerals as each other in the figures.

First Embodiment

A first embodiment will be described. A heat exchanger of the present embodiment exchanges heat between a first fluid and a second fluid. Specifically, the heat exchanger is used as an intercooler that causes intake air pressurized by a supercharger and increased in temperature and cooling water to exchange heat with each other to thereby cool the intake air.

Figure 2:
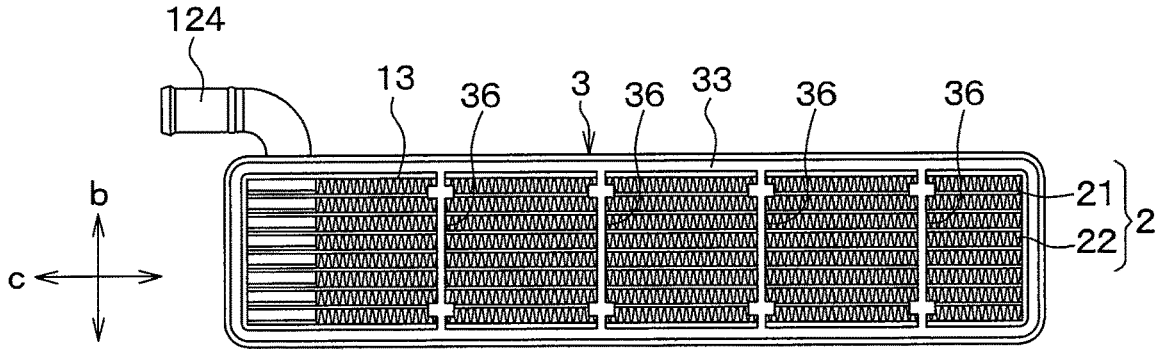
FIG. 2 is a plan view of the heat exchanger shown in FIG. 1 and not showing a tank.
Figure 3:
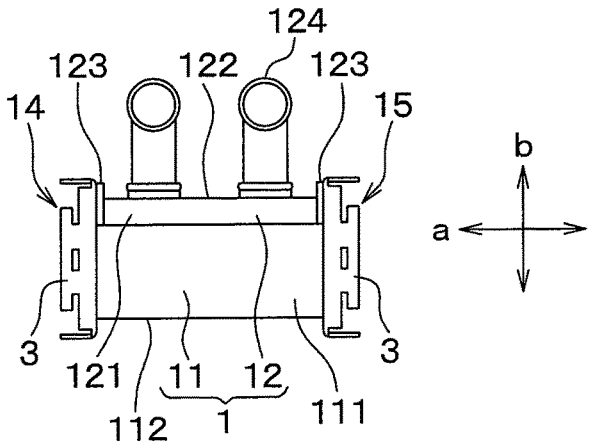
FIG. 3 is a left side view of the heat exchanger shown in FIG. 1 and not showing a tank.
Figure 4:
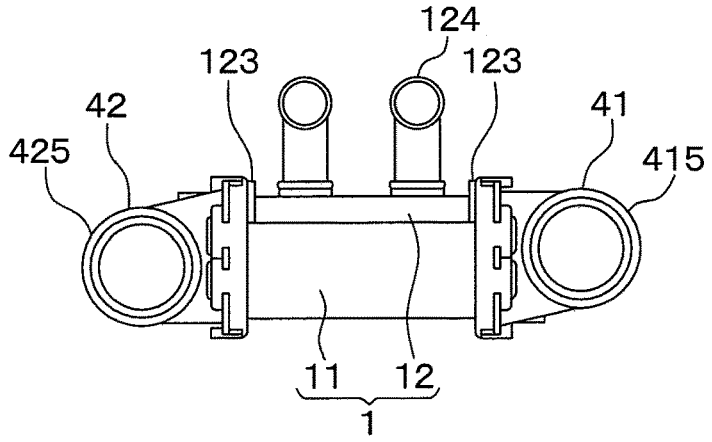
FIG. 4 is a right side view of the heat exchanger shown in FIG. 1 and showing a tank.
Figure 5:
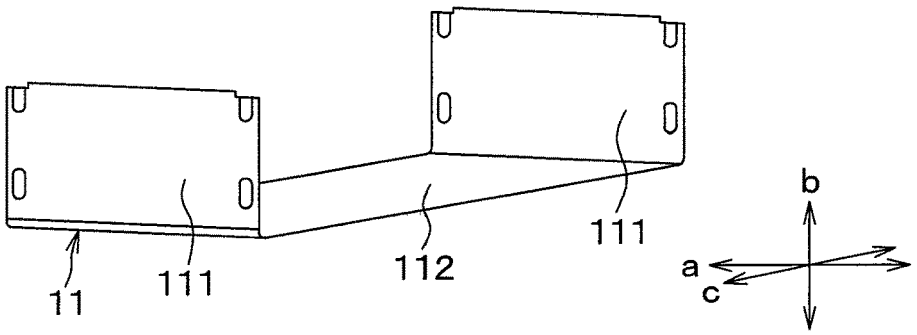
FIG. 5 is a perspective view of a first plate of the heat exchanger shown in FIG. 1.
Figure 6:
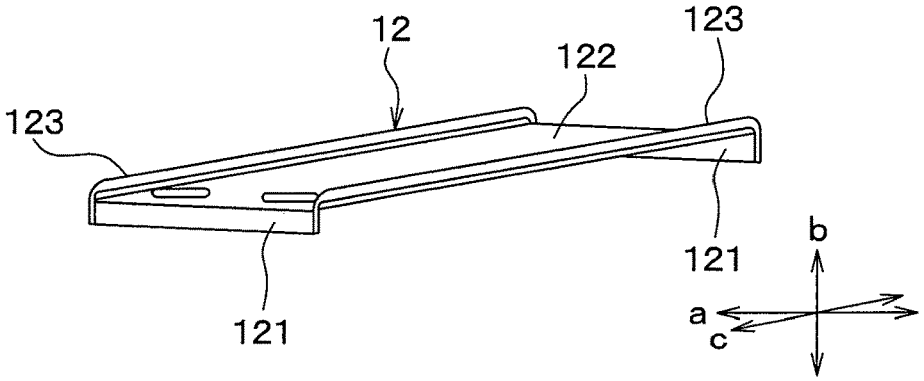
FIG. 6 is a perspective view of a second plate of the heat exchanger shown in FIG. 1.

The configuration of the heat exchanger of the present embodiment will be described with reference to FIGS. 1 to 9 and FIGS. 10A to 10C. FIG. 1 is a plan view of the heat exchanger. FIG. 2 is a plan view of the heat exchanger shown in FIG. 1 and not showing a tank. FIG. 3 is a left side view of the heat exchanger shown in FIG. 1 and not showing the tank. FIG. 4 is a left side view of the heat exchanger shown in FIG. 1 and showing the tank. FIG. 5 is a perspective view illustrating a first plate of the heat exchanger shown in FIG. 1. FIG. 6 is a perspective view illustrating a second plate of the heat exchanger shown in FIG. 1.

As shown in FIGS. 1 to 6, the heat exchanger includes, as main components, a first tank 41 through which the intake air is taken in and a cylindrical duct 1 through which the intake air having passed through the first tank flows. Further, the heat exchanger includes, as main components, a stacked core 2 housed in the duct 1 and a second tank 42 through which the intake air having passed through the stacked core 2 is discharged. The first tank 41 and the second tank 42 are tanks joined with a crimping plate 3 described later.

The first tank 41 and the second tank 42 are made of metal such as aluminum or resin such as nylon. The first tank 41 has an inlet port 41*a* and is connected to a supercharger (not shown) through a hose or the like. The second tank 42 has an outlet port 42*a* and is connected to an intake port of an engine.

The duct 1 includes the first plate 11 and the second plate 12 formed of a thin plate of aluminum, for example, by pressing to have a specific shape. An intake air passage 13 through which the intake air flows is defined in the duct 1. The inlet port 14 for the first fluid is located on one end side of the intake air passage 13 that is a first passage. The outlet port 15 for the first fluid is located on the other end side of the intake air passage 13 that is the first passage.

The stacked core 2 includes multiple tubes 21 whose cross-section have a flat shape, as shown in FIG. 2. A second passage through which a cooling fluid that is the second fluid flows is defined in each of the tubes 21. These tubes 21 are stacked with each other. The tubes 21 are made of metal such as aluminum or the like. A brazing material is clad on a surface of the tube 21.

An outer fin 22, which has a corrugated shape formed from a thin plate of metal such as aluminum for promoting heat exchange by increasing a heat transfer area, is provided between adjacent tubes 21 and joined to the tubes by brazing.

Hereinafter, a flow direction of the intake air in the duct 1 is referred to as a first fluid flow direction a, and a stacking direction of tubes 21 is referred to as a tube stacking direction b. Further, a direction perpendicular to both the first fluid flow direction a and the tube stacking direction b is referred to as a core width direction c. The core width direction c is acceptable as long as the direction intersects the first fluid flow direction a and the tube stacking direction b.

The first plate 11 is arranged to close three sides of the stacked core 2. Both ends of the stacked core 2 in the core width direction c are joined to first plate end board portions 111 by brazing, and an end surface of the stacked core 2 in the tube stacking direction b is joined to a first plate center board portion 112 by brazing.

The second plate 12 includes second plate end board portions 121, a second plate center board portion 122, and flange portions 123. The second plate end board portion 121 is joined by brazing to the first plate end board portion 111 that is an end surface in the core width direction c. The second plate center board portion 122 is joined by brazing to an end surface of the stacked core 2 in the tube stacking direction b.

The flange portions 123 are located on both end portions of the second plate 12 in the first fluid flow direction a and extend from the end portion of the second plate 12 to an outer side away from the intake air passage 13. The flange portion 123 includes a surface extending in the tube stacking direction b in a situation where the second plate 12 is joined to the stacked core 2, the first plate 11, and the crimping plate 3, and the flange portion 123 faces the crimping plate 3. The tube stacking direction b is perpendicular to the first fluid flow direction a in the present embodiment.

The first plate 11 and the second plate 12 are integrated to form the duct 1, and thereby the intake air passage 13 is defined. The intake air passage 13 has an approximately rectangular shape when viewed along the first fluid flow direction a.

The crimping plate 3 is formed by pressing a thin plate of metal such as aluminum to have an approximately rectangular frame shape. The crimping plate 3 is joined to an end portion of the duct 1 to encircle the inlet port 14 or the outlet port 15 of the duct 1.

The second plate 12 includes a pipe 124 connected to a pipe (not shown) through which a cooling fluid flows. The pipe connects a heat exchanger (not shown) cooling the cooling fluid and the heat exchanger of the present embodiment.

Figure 7:
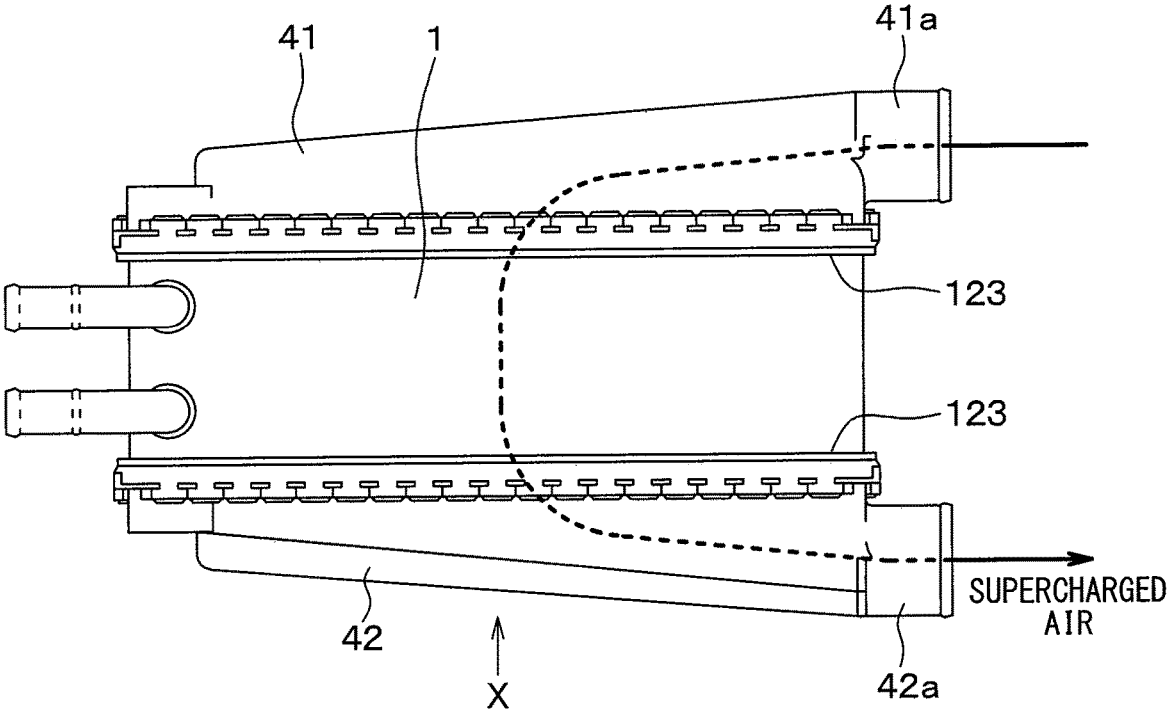
FIG. 7 is a diagram for describing a flow of intake air in the heat exchanger shown in FIG. 1.

In the configuration described above, the intake air flows from the inlet port 41*a* of the first tank 41 into the intake air passage 13 of the duct 1 through the first tank 41, and flows through the intake air passage 13, as indicated by an arrow shown in FIG. 7. Subsequently, the intake air flows out from the outlet port 42*a* of the second tank 42 to an outside through the second tank 42.

Figure 8:
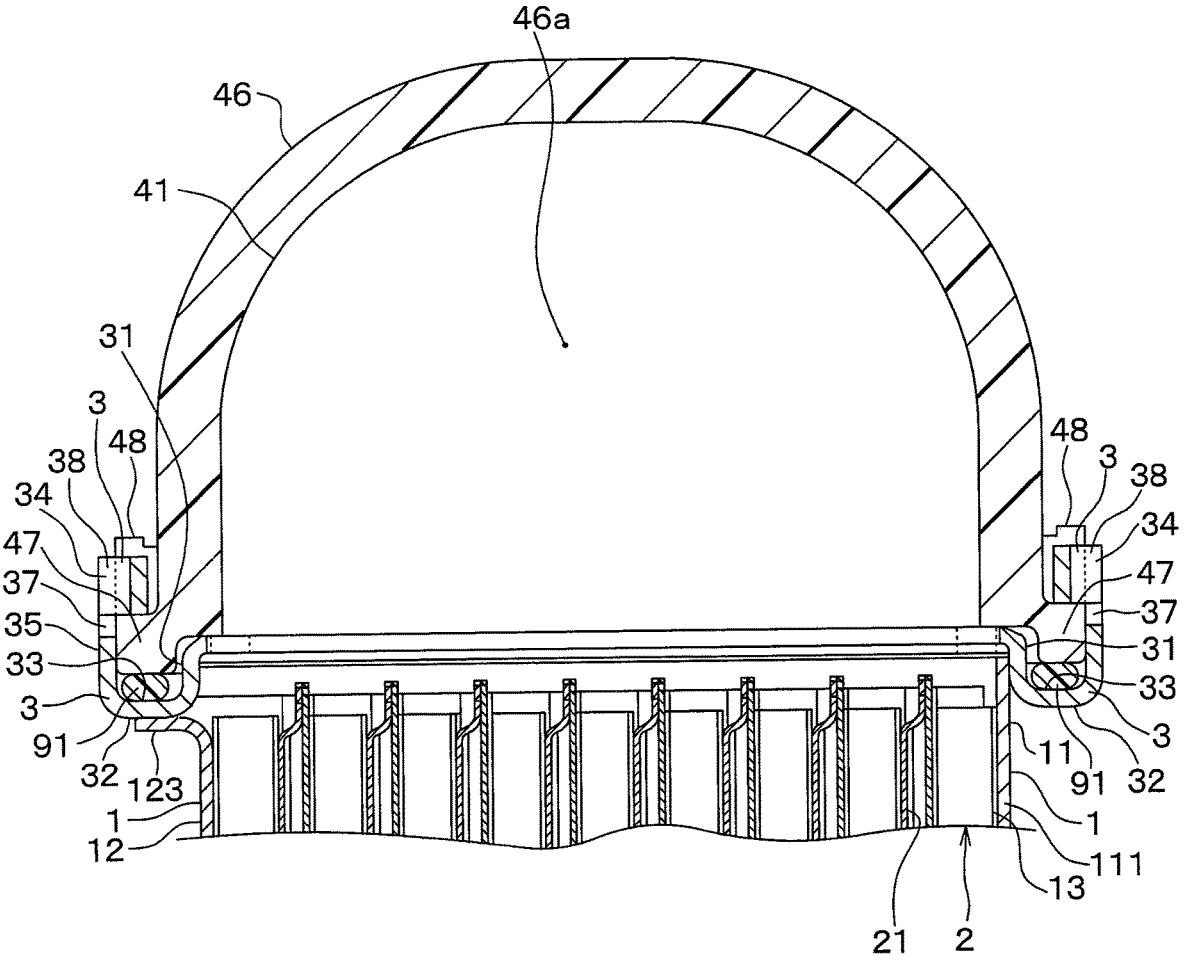
FIG. 8 is a cross-sectional view taken along a line VIII-VIII shown in FIG. 1.

FIG. 8 is a cross-sectional view taken along a line VIII-VIII shown in FIG. 1. As shown in FIG. 8, the crimping plate 3 includes a bottom portion wall 32, an inner wall 31 extending from an inner peripheral portion of the bottom portion wall 32, and a groove portion 33 whose cross-section is U-shape defined by an outer wall 35. The inner wall 31 of the crimping plate 3 and an outer wall of the first plate 11 are joined with each other by brazing. The bottom portion wall 32 of the crimping plate 3 and the flange portion 123 of the second plate 12 are joined with each other by brazing. The groove portion 33 of the crimping plate 3 is formed by pressing. In the present embodiment, the bottom portion wall 32 corresponds to an opposing wall that encircles the inlet port 14 or the outlet port 15 shown in FIG. 3 and faces an end portion of the tank 41 or the tank 42 facing the duct 1.

A packing 91 made of fluoro-rubber, silicone rubber or the like is inserted into the groove portion 33 of the crimping plate 3, and then an edge portion 47 of a tank body 46 described later is inserted into the groove portion 33. Subsequently, an outer edge portion 34 of the crimping plate 3 is crimped to join the crimping plate 3 and the tank body 46.

Four beam portions 36 extending in the tube stacking direction b is integrated with the crimping plate 3. The crimping plate 3 includes multiple hole portions 37 at regular intervals. Each hole portion 37 has an ellipse shape, and hole portions 37 are arranged in a straight line along an end portion of the outer wall 38 of the crimping plate 3.

The first tank 41 of the present embodiment includes the tank body 46 defining an inner space 46*a* connected to a duct opening that is one of the inlet port 14 and the outlet port 15 of the duct 1, and multiple outer protrusions 48 protruding outward from the tank body 46.

The edge portion 47 extends toward the duct 1 and is configured to be engaged with the groove portion 33 of the crimping plate 3.

Figure 9:
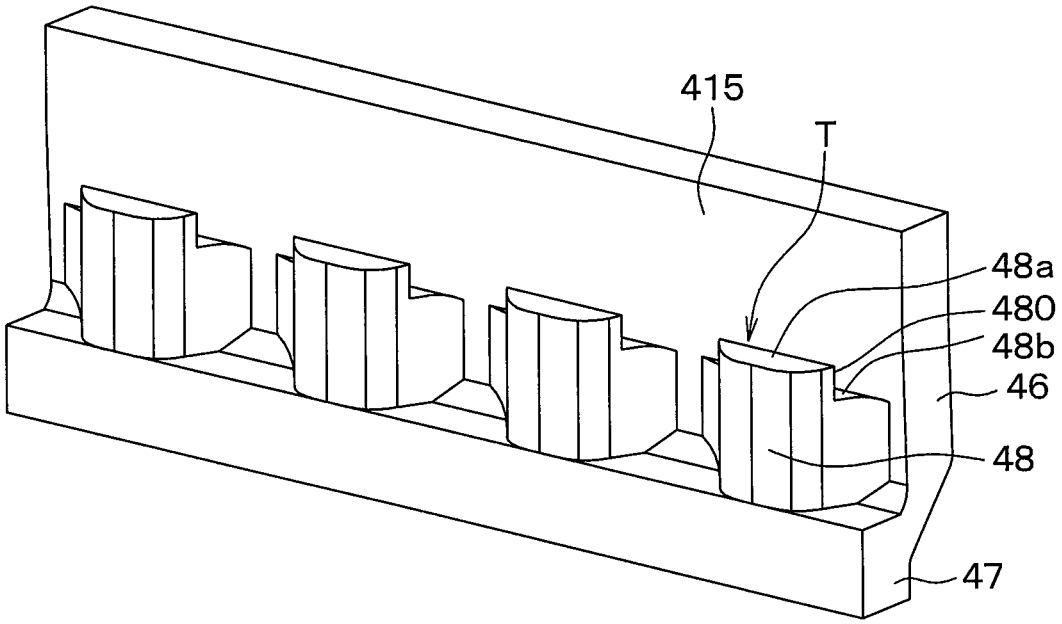
FIG. 9 is an enlarged perspective view illustrating protrusions provided on an edge portion of the tank of the heat exchanger according to the first embodiment.

A cross-section of the outer protrusion 48 has a half ellipse shape as shown in FIG. 9. The outer protrusion 48 is located between the tank body 46 and the outer wall 35 of the crimping plate 3. The outer protrusion 48 of the present embodiment corresponds to a protrusion protruding outward from the edge portion 47 of the tank body. The outer protrusions 48 are adjacent to each other. The outer protrusions 48 are located on an opposite side of the edge portion 47 opposite from a surface of the edge portion 47 in contact with the packing 91.

A pushed surface 48*a* and an engagement groove 48*b* are formed at a top portion T of the outer protrusion 48 farthest from the edge portion 47, and the engagement groove 48*b* is closer to the tank body 46 than the pushed surface 48*a* is to.

Next, a method for manufacturing the heat exchanger of the present embodiment will be explained below. Since the manufacturing method of the heat exchanger is similar to a typical method excepting a step of crimping, only the crimping of the crimping plate 3 to the first tank 41 will be explained with reference to FIGS. 10A to 10C.

Figure 10A:
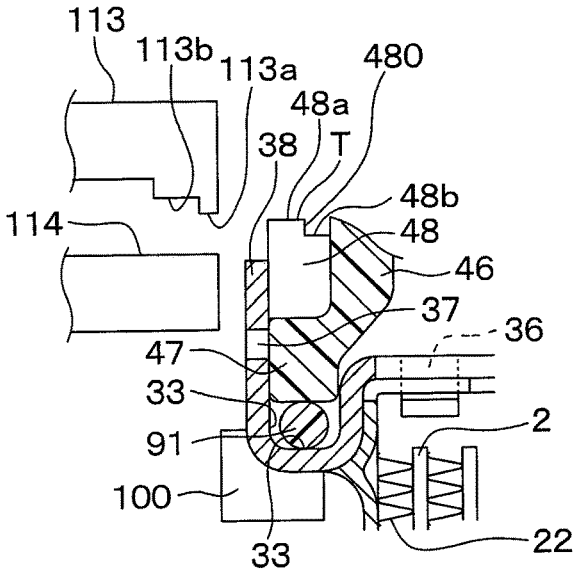
FIG. 10A is a diagram illustrating a situation where the tank of the heat exchanger according to the first embodiment is inserted into a groove of a crimping plate before protrusions are pushed.

First, the first tank 41 and the crimping plate 3 are provided, the stacked core 2 joined with the duct 1 by brazing is placed on a core supporting member 100 as shown in FIG. 10A, and the packing 91 and the edge portion 47 of the first tank 41 are inserted in order into the groove portion 33 of the crimping plate 3. As a result, the hole portions 37 of the crimping plate 3 are positioned at predetermined positions between the outer protrusions 48.

Figure 10B:
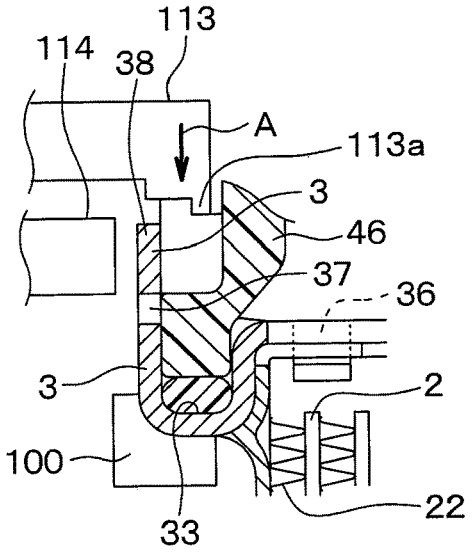
FIG. 10B is a diagram illustrating a situation where the protrusions of the tank is pushed by a tank pushing member.

Next, the outer protrusions 48 of the first tank 41 are pushed down with a tank pushing member 113 to compress the packing 91 as indicated by an arrow A shown in FIG. 10B. A stress is exerted on the packing 91, and the packing 91 is elastically deformed.

Figure 10C:
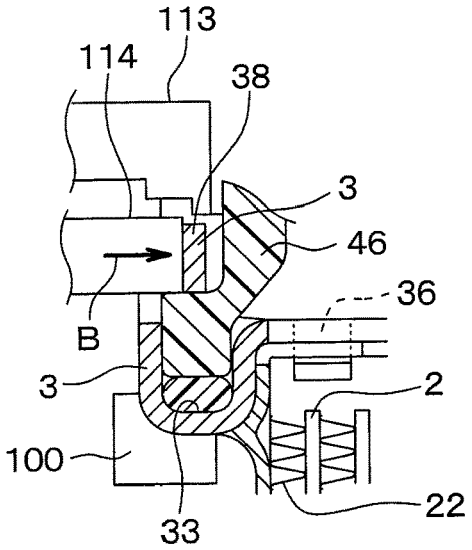
FIG. 10C is a diagram illustrating a situation where the tank is fixed by crimping the crimping plate while the protrusions of the tank is pushed by the pushing member.

Next, a stress is exerted by a punch 114 on a part of the crimping plate 3 in a direction intersecting the pushing direction by the tank pushing member 113 to push the part toward the first tank 41, as indicated by an arrow B shown in FIG. 10C. The stress by the punch 114 is exerted on an end portion of the crimping plate 3 that is closer to the outer wall 38 of the crimping plate 3 than to the hole portion 37 of the crimping plate 3. As a result, the end portion of the outer wall 38 of the crimping plate 3 is deformed to enter a valley portion between adjacent outer protrusions 48, and the crimping plate 3 is fixed to the first tank 41 by crimping.

A surface 480 of the engagement groove 48*b* closest to the punch 114 in the engagement groove 48*b* is a contact surface that abuts a protrusion 113*a* of the tank pushing member 113. In the present embodiment, since the protrusion 113*a* of the tank pushing member 113 abuts the contact surface 480, a motion of the first tank 41 due to the crimping stress caused by the punch in a direction of the crimping stress can be limited. Consequently, a stress on the duct 1 and the stacked core 2 can be significantly reduced, and a deformation of the beam portion 36 and a buckling of one of the outer fins that is the outermost one in the stacked core 2 can be suppressed.

Next, the pushing by the punch 114 and the tank pushing member 113 is stopped, and the crimping to the first tank 41 is finished. In the present embodiment, multiple parts of the crimping plate 3 are pushed simultaneously. Although the crimping to the first tank 41 is described above, the crimping to the second tank 42 is performed in the same way.

According to the above-described structure, the heat exchanger includes the duct 1, the stacked core 2, tanks 41, 42, and the crimping plate 3. The first passage through which the first fluid flows is defined in the duct 1, and the duct 1 includes the inlet port 14 for the first fluid on the one end side of the first passage and the outlet port 15 for the first fluid on the other end side of the first passage. The stacked core 2 is housed in the duct 1. The second passage through which the second fluid flows is defined in the stacked core 2, and the stacked core 2 exchanges heat between the first fluid and the second fluid. The tanks 41, 42 include the tank body 46 defining the inner space 46*a* connected to the duct opening that is one of the inlet port and the outlet port, and the protrusions 48, 44 protruding outward from the edge portion 47 provided on the tank body. The crimping plate 3 includes the bottom portion wall 32 that is the opposing wall encircling the inlet port or the outlet port and facing the end portion of the tank facing the duct, and the outer wall 35 extending from an outer circumference of the opposing wall toward the tank. The opposing wall or the inner circumference of the opposing wall is joined to the duct to fix the tank. The protrusion includes the contact surface 480 facing in a direction angled toward the inner space 46*a* of the tank body 46 from the direction in which the outer wall 35 extends from the bottom portion wall 32.

Accordingly, the crimping plate 3 can be crimped by pushing the outer wall 38 toward the tank while the pushing member 113 is engaged with the surface of the protrusion facing in the direction angled toward the inner space 46*a* of the tank body 46 from the direction in which the outer wall 35 extends from the opposing wall 32 (i.e. the bottom portion wall). Accordingly, the crimping stress exerted on the duct can be reduced, deformation of the core during the crimping of the crimping plate to fix to the tank can be suppressed. Moreover, since the pushing stress by the tank pushing member 113 can be small, a size of the tank pushing member 113 can be decreased.

The outer protrusion 48 located between the tank body 46 and the outer wall 38 of the crimping plate 3 has the top portion T that is an end portion in a direction in which the outer wall 35 extends from the opposing wall 32 (i.e. the bottom portion wall). The engagement groove 48*b* recessed in a direction opposite from the direction in which the outer wall 35 extends from the opposing wall 32 (i.e. the bottom portion wall) is formed in the top portion T, and the engagement groove 48*b* has the surface facing toward the inner space 46*a* of the tank body 46.

That is, the surface facing toward the inner space 46*a* of the tank body 46 can be provided on the engagement groove 48*b* formed in the top portion T.

The above-described method for manufacturing the heat exchanger includes the steps of: providing the stacked core 2 housed in the duct 1, and the tanks 41, 42; providing the crimping plate 3; and crimping the outer wall 35 of the crimping plate 3.

Regarding the providing the stacked core 2 housed in the duct 1, the duct 1, which includes the first passage through which the first fluid flows, the inlet port 14 for the first fluid on the one end side of the first passage and the outlet port 15 for the first fluid on the other end side of the first passage, is provided. Subsequently, the stacked core 2 housed in the duct 1 is provided. The second passage through which the second fluid flows is defined in the stacked core 2, and the stacked core 2 exchanges heat between the first fluid and the second fluid.

Further, the tank is provided. The tank includes: the tank body 46 in which the inner space 46*a* connected to one of the inlet port and the outlet port; and the outer protrusion 48 protruding outward from the tank body 46 and located between the tank body 46 and the outer wall.

Regarding the providing the crimping plate 3, the crimping plate 3 includes the opposing wall 32 (i.e. the bottom portion wall) encircling the inlet port 14 or the outlet port 15 and facing the end portion of the tank 41, 42 facing the duct 1 and the outer wall 35 extending from the outer circumference of the opposing wall 32 (i.e. bottom portion wall) toward the tank 41, 42. The inner circumference of the opposing wall 32 of the crimping plate 3 is joined with the duct 1 to fix the tank 41, 42.

In the crimping the outer wall 38 of the crimping plate 3, the outer wall 38 of the crimping plate 3 is crimped to fix to the tank by pushing the outer wall 35 in the direction intersecting the direction in which the outer wall 35 extends from the opposing wall 32 (i.e. bottom portion wall) in a condition where the outer protrusion 48 of the tank 41, 42 is pushed down with the pushing member 113.

Regarding the providing the tank, the tank includes the contact surface 480 that faces in the direction angled toward the inner space 46*a* of the tank body 46 from the direction in which the outer wall 35 of the opposing wall 32 (i.e. the bottom portion wall). The contact surface 480 contacts with the pushing member 113.

In the crimping the outer wall 35 of the crimping plate 3 to fix to the tank 41, 42, a part of the crimping plate 3 is crimped while a motion of the tank in the direction in which the tank is pushed is limited by abutting the pushing member 113 onto the contact surface 480.

Accordingly, since a part the crimping plate is crimped while a motion of the tank in the direction in which the tank is pushed is limited by abutting the pushing member 113 onto the contact surface 480, deformation of the core during the crimping of the crimping plate can be suppressed.

Regarding the providing the tank, the tank includes the engagement groove 48*b* recessed in the direction opposite from the direction in which the outer wall 35 extends from the opposing wall 32 (i.e. the bottom portion wall) in the top portion T located in the end portion in the direction in which the outer wall extends from the opposing wall of the outer protrusion.

Accordingly, since a part the crimping plate is crimped while a motion of the tank in the direction in which the tank is pushed is limited by abutting the pushing member 113 onto the engagement groove 48*b* provided in the top portion T, deformation of the core during the crimping to the tank can be suppressed.

Second Embodiment

A heat exchanger according to a second embodiment will be described. The heat exchanger according to the first embodiment includes the engagement groove 48*b* is provided in the top portion T of the outer protrusion 48, the protrusion 113*a* of the tank pushing member 113 is engaged with the engagement groove 48*b*, and a part of the crimping plate 3 is crimped.

Figure 11:
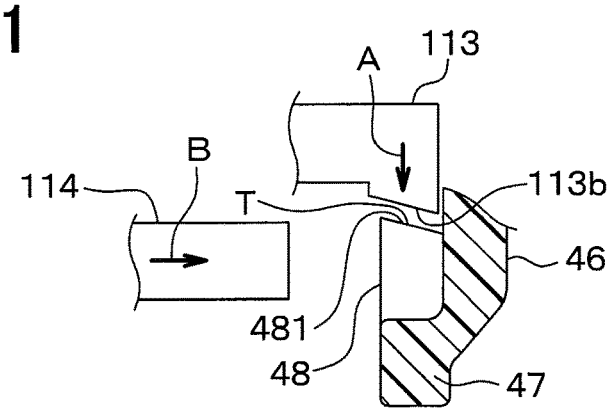
FIG. 11 is a perspective view illustrating a protrusion provided on an edge portion of a tank of the heat exchanger according to a second embodiment.

In contrast, in the heat exchanger of the present embodiment, both a pushed surface 481 of the outer protrusion 48 of the first tank 41 and a pushing surface 113*b* of the tank pushing member 113 are sloping toward the inner space 46*a* of the tank body 46, as shown in FIG. 11. That is, the outer protrusion 48 slopes such that height of the outer protrusion 48 decreases in a direction in which the stress by the punch is exerted, and the contact surface of the tank pushing member 113 abutting onto the outer protrusion 48 has the same slope. As a result, motion of the tank due to the crimping stress is limited, and the same effects as the first embodiment can be obtained. The pushed surface 481 is an inclined surface whose normal is inclined toward the inner space from the direction in which the outer wall 35 extends from the opposing wall 32 (i.e. the bottom portion wall).

Third Embodiment

Figure 12:
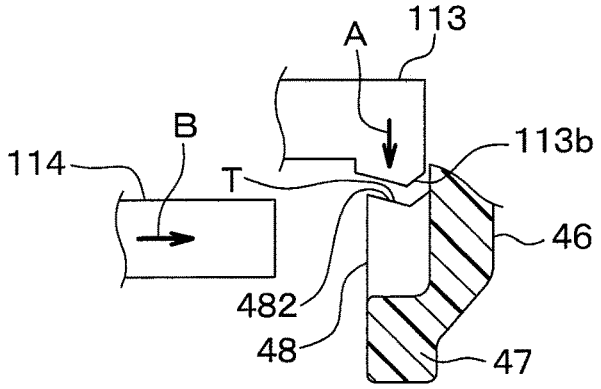
FIG. 12 is a perspective view illustrating a protrusion provided on an edge portion of a tank of the heat exchanger according to a third embodiment.

A heat exchanger according to a third embodiment will be described. In the heat exchanger of the present embodiment, a cross-section of a pushed surface 482 of the outer protrusion 48 of the first tank 41 has a V-shape, and a cross-section of a tank pushing surface 113*b* of the tank pushing member 113 has a V-shape, as shown in FIG. 12. Accordingly, a part of the pushed surface is an inclined surface whose normal is inclined toward the inner space from the direction in which the outer wall 35 extends from the opposing wall 32 (the bottom portion wall).

That is, the outer protrusion 48 slopes such that height of the outer protrusion 48 decreases half and increases half in a direction in which the stress by the punch is exerted, and the contact surface of the tank pushing member 113 abutting onto the outer protrusion 48 has the same slope. As a result, motion of the tank due to the crimping stress is limited, and the same effects as the first embodiment can be obtained. The tank pushing member 113 is an inclined surface whose normal is inclined toward the inner space from the direction in which the outer wall 35 extends from the opposing wall 32 (i.e. the bottom portion wall).

The present embodiment can achieve the effects and advantages, which are obtained from the common structure common to the first embodiment.

Fourth Embodiment

Figure 13:
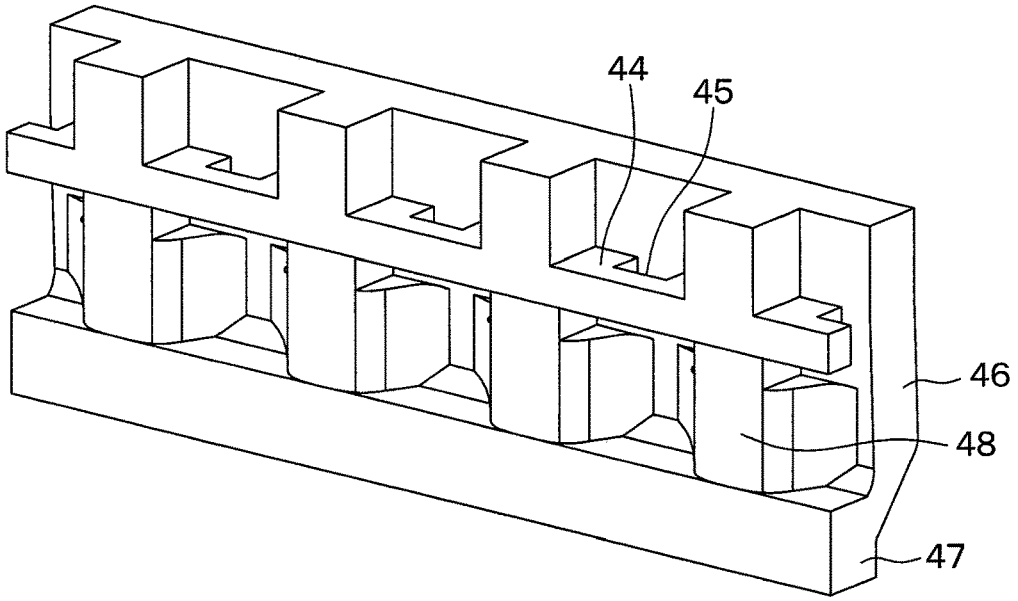
FIG. 13 is a perspective view illustrating a protrusion provided on an edge portion of a tank of the heat exchanger according to a fourth embodiment.

A heat exchanger according to the present embodiment includes, as shown in FIG. 13, multiple outer protrusions 48 on the outer wall of the first tank 41 and ribs 44 extending along the outer protrusions 48. The rib 44 includes an engagement hole 45. The engagement hole 45 extends through the rib 44 in a direction in which the packing 91 is compressed, the rib 44 and the outer protrusion 48 constitute the protrusion protruding outward from the tank body 46.

In the present embodiment, the engagement hole 45 defined between the rib 44 and the first tank 41 has a surface 483 that faces toward the inner space 46*a* of the tank body 46. The surface 483 faces in a direction angled toward the inner space 46*a* of the tank body 46 from the direction in which the outer wall 35 extends from the bottom portion wall 32 of the groove portion 33 of the crimping plate 3.

Figure 14:
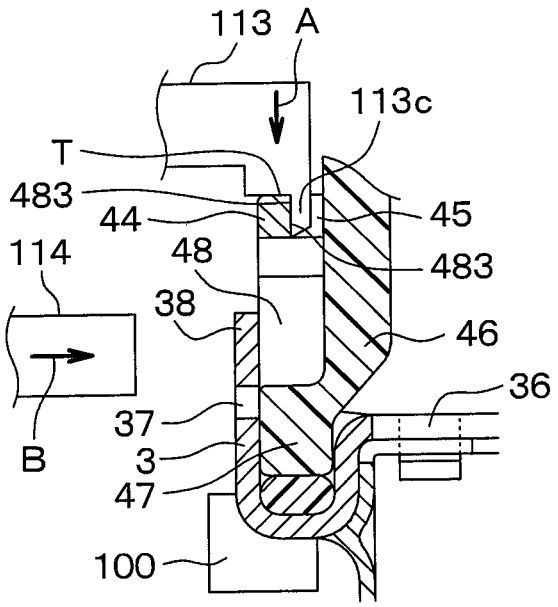
FIG. 14 is a diagram for explaining a fixation of a crimping plate to the tank of the heat exchanger according to the fourth embodiment.

Next, fixation of the crimping plate 3 to the first tank 41 in the present embodiment will be described with reference to FIG. 14. First, the stacked core 2 joined with the duct 1 by brazing is placed on the core supporting member 100 as shown in FIG. 14, and the packing 91 and the edge portion 47 of the tank body 46 are inserted into the groove portion 33 of the crimping plate 3 whose cross-section has a U-shape.

Next, the rib 44 of the first tank 41 is pushed down with the tank pushing member 113, as indicated by an arrow A, in a direction opposite from the direction in which the outer wall 35 extends from the bottom portion wall 32 of the groove portion 33 of the crimping plate 3, and the packing 91 is compressed to become a predetermined size. A stress is exerted on the packing 91, and the packing 91 is elastically deformed. At this moment, the protrusion 113*c* of the tank pushing member 113 is engaged with the engagement hole 45 of the rib 44, and the rib 44 is pushed down.

Next, while the rib 44 of the first tank 41 is pushed down with the tank pushing member 113, a stress is exerted with the punch to push a part of the crimping plate 3 toward the first tank 41 in a direction indicated by an arrow B intersecting with the arrow A, and thereby the crimping plate 3 is crimped to the first tank 41. In this manner, the first tank 41 is fixed by crimping.

The present embodiment can achieve the effects and advantages, which are obtained from the structure common to the first embodiment.

In contrast, when the duct is engaged with an inner peripheral surface of the crimping plate as in comparative example, it is not possible to provide a supporting member on the inner peripheral side of the crimping plate to support the inner peripheral side of the crimping plate. As a result, a large stress may be exerted on the core during crimping the crimping plate, and the core may be deformed inwardly. The mechanism how the deformation occurs will be described with reference to FIGS. 15A and 15B.

Figure 15A:
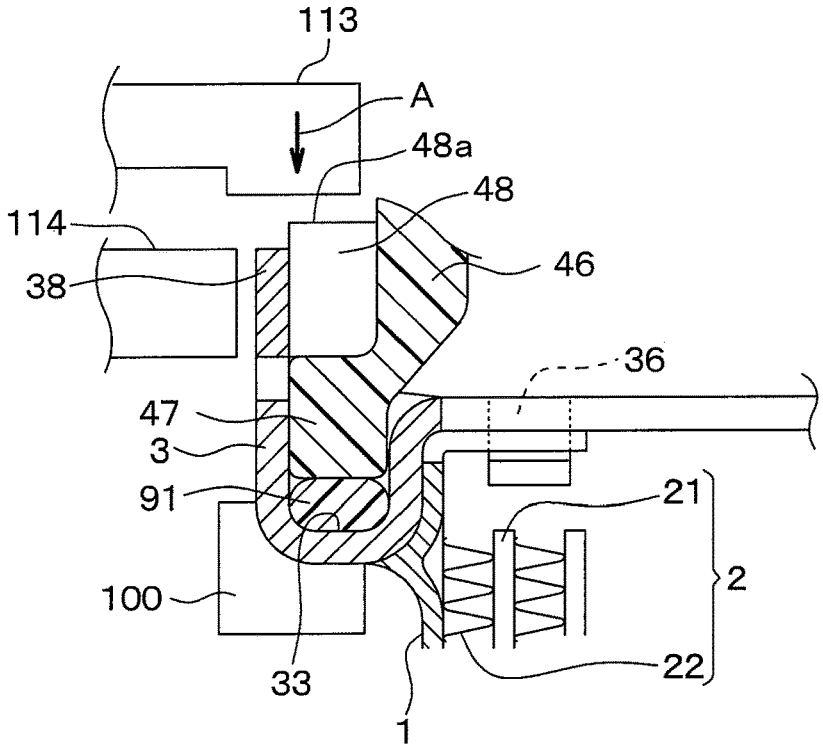
FIG. 15A is a diagram illustrating a heat exchanger according to a comparative example.

First, the core 2 joined with the duct 1 by brazing is placed on the core supporting member 100 as shown in FIG. 15A, and the packing 91 and the edge portion 47 of the tank body 46 are inserted into the groove portion 33 of the crimping plate 3 whose cross-section has a U-shape. Next, the pushed surface 48*a* of the outer protrusion 48 that is integrated with the edge portion 47 is pushed down with the tank pushing member 113 such that the packing 91 becomes a predetermined size.

Figure 15B:
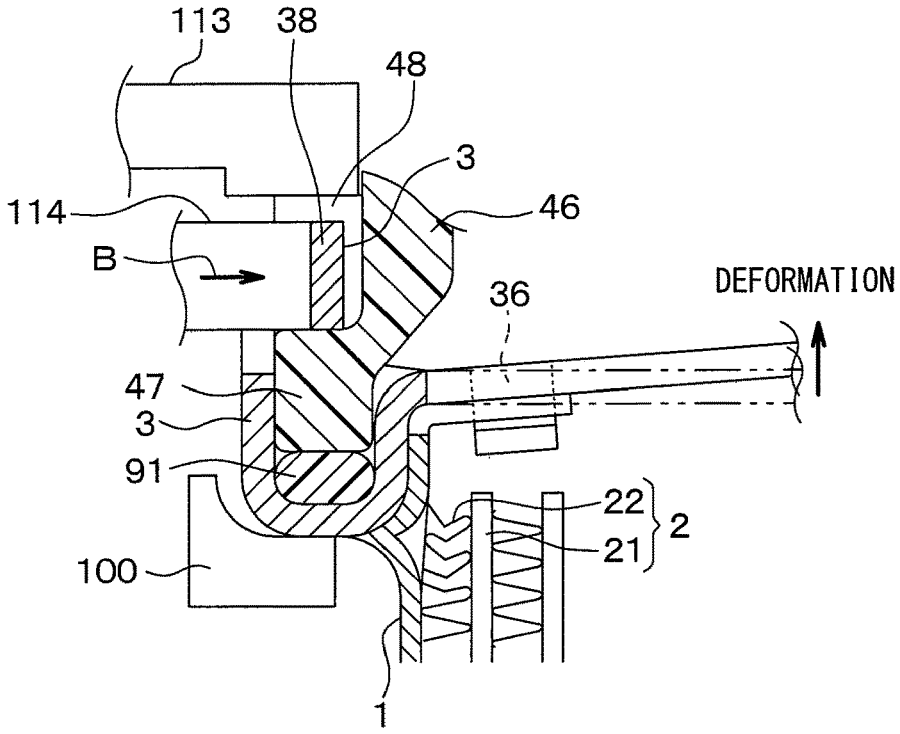
FIG. 15B is a diagram illustrating a heat exchanger according to a comparative example.

Next, while the tank 41 and the packing 91 are pushed down as shown in FIG. 15B, the crimping plate 3 is crimped and fixed to the tank 41 by elastically deforming the crimping plate 3 via exerting a stress with punch to push an end portion of the crimping plate 3 on the outer wall 38 side toward the tank 41. Although the tank 41 is held by frictional force between the tank 41 and the tank pushing member 113 during the crimping of the tank 41, the above-described problem may occur if the crimping stress exceeds the frictional force.

That is, when the crimping stress exceeds the frictional force, the crimping stress is transmitted to the end portion of the outer wall 38 of the crimping plate 3, the tank 41, and the duct 1, in order. As a result, deformation of the beam portion 36 of the crimping plate 3, and buckling of the outer fin 22 of the core 2 may occur, and thereby pressure resistance may decrease.

Other Embodiments (1) In the above-described fourth embodiment, the rib 44 formed on the outer wall of the first tank 41 has the engagement hole 45 extending through the rib 44 in the direction in which the outer wall 35 extends from the bottom portion wall 32 of the groove portion 33 of the crimping plate 3. However, the engagement hole 45 may be substituted by a recess portion recessed in the direction in which the outer wall 35 extends from the bottom portion wall 32 of the groove portion 33, or a recess portion recessed in a direction opposite from the direction in which the outer wall 35 extends from the bottom portion wall 32 of the groove portion 33.

(2) In the above-described embodiments, the contact surface extending in a direction intersecting a direction in which the first tank 41 is pressed is provided in the outer protrusion 48 or the rib 44. However, the contact surface may be provided in a part other than the outer protrusion 48 and the rib 44.

(3) In the above-described embodiments, the first and second tanks 41, 42 are fixed by crimping using the crimping plate 3 having the groove portion 33 whose cross-section has U-shape constituted by the bottom portion wall 32, the inner wall 31, and the outer wall 35. In contrast, the first and second tanks 41, 42 may be fixed by crimping using the crimping plate 3 having a part whose cross-section has S-shape constituted by the bottom portion wall 32, the inner wall 31, and the outer wall 35.

(4) Although the crimping plate 3 includes the beam portion 36 in the above-described embodiments, the beam portion 36 is not essential.

The present disclosure is not limited to the above-described embodiments, and can be appropriately modified. Individual elements or features of a particular embodiment are generally not limited to that particular embodiment, but, where applicable, are interchangeable and can be used in a selected embodiment, even if not specifically shown or described. Individual elements or features of a particular embodiment are not necessarily essential unless it is specifically stated that the elements or the features are essential in the foregoing description, or unless the elements or the features are obviously essential in principle. A quantity, a value, an amount, a range, or the like, if specified in the above-described example embodiments, is not necessarily limited to the specific value, amount, range, or the like unless it is specifically stated that the value, amount, range, or the like is necessarily the specific value, amount, range, or the like, or unless the value, amount, range, or the like is obviously necessary to be the specific value, amount, range, or the like in principle. Furthermore, a material, a shape, a positional relationship, or the like, if specified in the above-described example embodiments, is not necessarily limited to the specific material, shape, positional relationship, or the like unless it is specifically stated that the material, shape, positional relationship, or the like is necessarily the specific material, shape, positional relationship, or the like, or unless the material, shape, positional relationship, or the like is obviously necessary to be the specific material, shape, positional relationship, or the like in principle.

CONCLUSION

According to a first aspect described in a part or whole parts of the above-described embodiments, the heat exchanger exchanges heat between the first fluid and the second first fluid, and includes the duct, the core, the tank, and the crimping plate. The first passage through which the first fluid flows is defined in the duct, and the duct includes the inlet port for the first fluid on the one end side of the first passage and the outlet port for the first fluid on the other end side of the first passage. The core is housed in the duct. The second passage through which the second fluid flows is defined in the stacked core, and the stacked core exchanges heat between the first fluid and the second fluid. The tanks include the tank body defining the inner space connected to the duct opening that is one of the inlet port and the outlet port, and the protrusions protruding outward from the edge portion provided on the tank body. The crimping plate includes the opposing wall encircling the inlet port or the outlet port and facing the end portion of the tank facing the duct, and the outer wall extending from an outer circumference of the opposing wall toward the tank. The inner circumference of the opposing wall is joined to the duct to fix the tank. The protrusion includes the surface facing in a direction angled toward the inner wall from the direction in which the outer wall extends from the bottom portion wall.

According to a second aspect, the protrusion is the outer protrusion located between the tank body and the outer wall of the crimping plate. The outer protrusion includes the top portion that is an end portion of the outer protrusion in the direction in which the outer wall extends from the opposing wall of the. The engagement groove recessed in a direction opposite from the direction in which the outer wall extends from the opposing wall is formed in the top portion, and the engagement groove has the surface facing toward the inner space.

According to a third embodiment, the protrusion is the outer protrusion that is located between the tank body and the outer wall of the crimping plate. The outer protrusion includes the top portion that is an end portion of the outer protrusion in the direction in which the outer wall extends from the opposing wall of the. The top portion includes the inclined surface whose normal is inclined toward the inner space from the direction in which the outer wall extends from the opposing wall.

According to a fourth aspect, the protrusion includes multiple outer protrusions located between the tank body and the outer wall of the crimping plate, and the rib provided along the outer protrusions. The rib includes the recess portion or the hole portion. The recess portion is recessed in the direction in which the outer wall extends from the opposing wall or in the direction opposite from the direction in which the outer wall extends from the opposing wall. The recess portion or the hole portion of the rib includes the surface facing in the direction angled toward the inner space.

According to a fifth aspect, the above-described method for manufacturing the heat exchanger that exchanges heat between the first fluid and the second fluid includes the steps of: providing the core housed in the duct, and the tanks; providing the crimping plate; and crimping the outer wall of the crimping plate.

Regarding the providing the core housed in the duct, the duct, which includes the first passage through which the first fluid flows, the inlet port for the first fluid on the one end side of the first passage and the outlet port for the first fluid on the other end side of the first passage, is provided. Subsequently, the core housed in the duct is provided. The second passage through which the second fluid flows is defined in the core, and the core exchanges heat between the first fluid and the second fluid. Further, the tank is provided. The tank includes: the tank body in which the inner space connected to one of the inlet port and the outlet port; and the outer protrusion protruding outward from the edge portion of the tank body and located between the tank body and the outer wall.

The crimping plate includes the opposing wall encircling the inlet port or the outlet port and facing the end portion of the tank facing the duct, and the outer wall extending from an outer circumference of the opposing wall toward the tank. The inner circumference of the opposing wall is joined to the duct to fix the tank.

In the crimping the outer wall of the crimping plate, the outer wall of the crimping plate is crimped to fix to the tank by pushing the outer wall in the direction intersecting the direction in which the outer wall extends from the opposing wall in a condition where the protrusion of the tank is pushed down with the pushing member.

Regarding the providing the tank, the tank includes the contact surface that faces in the direction angled toward the inner space from the direction in which the outer wall of the opposing wall. The contact surface contacts with the pushing member. In the crimping the outer wall of the crimping plate to fix to the tank, a part of the crimping plate is crimped while a motion of the tank in the direction in which the tank is pushed is limited by abutting the pushing member onto the contact surface.

According to a sixth aspect, the tank includes the engagement groove recessed in the direction opposite from the direction in which the outer wall extends from the opposing wall in the top portion located in the end portion in the direction in which the outer wall extends from the opposing wall of the outer protrusion.

Accordingly, since a part the crimping plate is crimped while a motion of the tank in the direction in which the tank is pushed is limited by abutting the pushing member onto the engagement groove provided in the top portion, deformation of the core during the crimping to the tank can be suppressed.

According to a seventh aspect, the tank includes the inclined surface whose normal is inclined toward the inner space from the direction in which the outer wall extends from the opposing wall in the top portion located in the end portion in the direction in which the outer wall extends from the opposing wall of the outer protrusion.

Accordingly, a part of the crimping plate is crimped while a motion of the tank in the direction in which the tank is pushed is limited by abutting the pushing member onto the inclined surface whose normal is inclined toward the inner space from the direction in which the outer wall extends from the opposing wall, deformation of the core during the crimping of the crimping plate can be suppressed.

According to an eighth aspect, the tank includes multiple outer protrusions located between the tank body and the outer wall, and the rib provided along the outer protrusions and having the recess portion or the hole portion. The recess portion is recessed in the direction in which the outer wall extends from the opposing wall or in the direction opposite from the direction in which the outer wall extends from the opposing wall. The hole portion extends through the rib in the direction in which the outer wall extends from the opposing wall.

Accordingly, since a part the crimping plate is crimped while a motion of the tank in the direction in which the tank is pushed is limited by abutting the pushing member onto the recess portion or the hole portion provided in the rib, deformation of the core during the crimping to the tank can be suppressed.

What is claimed is:

1. A heat exchanger that exchanges heat between a first fluid and a second fluid, the heat exchanger comprising:

a duct defining therein a first passage through which the first fluid flows, the duct including an inlet port for the first fluid located on one end side of the first passage, and an outlet port for the first fluid located on another end side of the first passage;

a core accommodated in the duct and defining therein a second passage through which the second fluid flows, the core exchanging heat between the first fluid and the second fluid;

a tank including a tank body defining an inner space connected to a duct opening that is one of the inflow port and the outflow port, and a protrusion protruding outward from an edge portion of the tank body; and a crimping plate joined to the duct and fixing the tank, the crimping plate including an opposing wall surrounding the inlet port or the outlet port and facing an edge of the tank that is adjacent to the duct, the opposing wall or an inner circumference of the opposing wall being joined to the duct, and an outer wall extending from an outer circumference of the opposing wall toward the tank, wherein the protrusion includes a surface facing in a direction angled toward the inner space from a direction in which the outer wall extends from the opposing wall.

2. The heat exchanger according to claim 1, wherein the protrusion includes an outer protrusion located between the tank body and the outer wall of the crimping plate, the outer protrusion includes a top portion that is an end portion of the outer protrusion in the direction in which the outer wall extends from the opposing wall, the top portion includes an engagement groove recessed in a direction opposite from the direction in which the outer wall extends from the opposing wall, and the engagement groove includes the surface facing in the direction angled toward the inner space.

3. The heat exchanger according to claim 1, wherein the protrusion includes an outer protrusion located between the tank body and the outer wall of the crimping plate, the outer protrusion includes a top portion that is an end portion of the outer protrusion in the direction in which the outer wall extends from the opposing wall, the top portion includes an inclined surface whose normal is inclined toward the inner space from the direction in which the outer wall extends from the opposing wall, and the surface facing in the direction angled toward the inner space includes the inclined surface.

4. The heat exchanger according to claim 1, wherein the protrusion includes a plurality of outer protrusions located between the tank body and the outer wall of the crimping plate, and a rib extending in a direction in which the plurality of outer protrusions are arranged, the rib includes a recess portion recessed in the direction in which the outer wall extends from the opposing wall or in a direction opposite from the direction in which the outer wall extends from the opposing wall, or a hole portion extending through the rib in the direction in which the outer wall extends from the opposing wall, and the recess portion or the hole portion includes the surface facing in the direction angled toward the inner space.

5. A method for manufacturing a heat exchanger that exchanges a first fluid and a second fluid, the method comprising:

providing a duct that defines therein a first passage through which the first fluid flows, includes an inlet port for the first fluid located on one end side of the first passage, and an outlet port for the first fluid located on another end side of the first passage, and accommodates a core defining therein a second passage through which the second fluid flows, the core exchanging heat between the first fluid and the second fluid;

providing a tank that includes a tank body defining an inner space connected to a duct opening that is one of the inflow port and the outflow port, and an outer protrusion extending protruding outward from an edge portion of the tank body, the outer protrusion being located between the tank body and the outer wall;

providing a crimping plate that is joined to the duct and fixes the tank, the crimping plate including an opposing wall surrounding the inlet port or the outlet port and facing an edge of the tank that is adjacent to the duct, the opposing wall or an inner circumference of the opposing wall being joined to the duct, and an outer wall extending from an outer circumference of the opposing wall toward the tank; and crimping and fixing the outer wall of the crimping plate to the tank by pushing the outer wall in a direction intersecting the direction in which outer wall extends from the opposing wall in a state where the outer protrusion of the tank is being pushed and fixed with a pushing member, wherein the tank includes a contact surface facing in a direction angled toward the inner space from a direction in which the outer wall extends from the opposing wall, the contact surface being configured to contact to the pushing member, and in the crimping the outer wall of the crimping plate to fix to the tank, a part of the crimping plate is crimped while a motion of the tank in a direction in which the outer wall is pushed is suppressed by contacting the pushing member to the contact surface of the tank.

6. The method for manufacturing the heat exchanger according to claim 5, wherein the tank includes an engagement groove provided in a top portion that is an end portion of the outer protrusion in the direction in which the outer wall extends from the opposing wall, the engagement groove being recessed in a direction opposite from the direction in which the outer wall extends from the opposing wall.

7. The method for manufacturing the heat exchanger according to claim 5, wherein the tank includes an inclined surface provided in a top portion that is an end portion of the outer protrusion in the direction in which the outer wall extends from the opposing wall, the inclined surface being inclined with respect to the direction in which the outer wall extends from the opposing wall to face toward the inner space.

8. The method for manufacturing the heat exchanger according to claim 5, wherein the outer protrusion is one of a plurality of outer protrusions located between the tank body and the outer wall, the tank includes the plurality of outer protrusions, and a rib provided along the plurality of outer protrusions are arranged, and the rib includes a recess portion recessed in the direction in which the outer wall extends from the opposing wall or in a direction opposite from the direction in which the outer wall extends from the opposing wall, or a hole portion extending through the rib in the direction in which the outer wall extends from the opposing wall.

* * * * *